US006736350B2

(12) United States Patent
Lamothe

(10) Patent No.: US 6,736,350 B2
(45) **Date of Patent: *May 18, 2004**

(54) WEB CONTROL MATRIX WITH SELECTABLE WEB ORIENTATION

(75) Inventor: Richard P. Lamothe, Burlington, CT (US)

(73) Assignee: Energy Saving Products and Sales Corp., Burlington, CT (US)

( * ) Notice: Subject to any disclaimer, the term of this patent is extended or adjusted under 35 U.S.C. 154(b) by 78 days.

This patent is subject to a terminal disclaimer.

(21) Appl. No.: 10/001,526

(22) Filed: Oct. 25, 2001

(65) Prior Publication Data

US 2003/0080240 A1 May 1, 2003

(51) Int. Cl.[7] ..... B65H 23/32
(52) U.S. Cl. ..... 242/615.21
(58) Field of Search ..... 242/615.21, 615.12

(56) References Cited

U.S. PATENT DOCUMENTS

| | | | | |
|---|---|---|---|---|
| 2,139,633 A | | 12/1938 | Hanson et al. | |
| 3,285,446 A | | 11/1966 | Strickland | |
| 3,337,107 A | | 8/1967 | Catallo et al. | |
| 4,346,855 A | | 8/1982 | Biggar, III | |
| 4,610,198 A | * | 9/1986 | Raymond | 242/615.21 |
| 4,863,087 A | * | 9/1989 | Kohler | 242/615.21 |
| 5,016,801 A | | 5/1991 | Gilat et al. | |
| 5,108,022 A | | 4/1992 | Birkmair et al. | |
| 5,174,096 A | | 12/1992 | Fukuda | |
| 5,611,473 A | | 3/1997 | Reinhold et al. | |
| 5,823,464 A | | 10/1998 | Bohn et al. | |
| 5,829,707 A | | 11/1998 | Lamothe | |
| 6,027,003 A | | 2/2000 | Gassner | |
| 6,047,922 A | | 4/2000 | Michalik | |
| 6,050,191 A | | 4/2000 | Enderle et al. | |
| 6,092,761 A | | 7/2000 | Mushaben | |
| 6,418,851 B1 | * | 7/2002 | Hartmann et al. | |

* cited by examiner

*Primary Examiner*—John M. Jillions
(74) *Attorney, Agent, or Firm*—McCormick, Paulding & Huber LLP

(57) ABSTRACT

A matrix is provided having at least two diagonal turnbars and one parallel turnbar respecting the direction a paperweb is fed into the matrix. By threading through the turnbars in one or another way, the paperweb exits either face-up or face-down as compared to its orientation upon entering the matrix. Additional turnbars enable the matrix to direct the paperweb to exit in any number of directions with either orientation.

15 Claims, 3 Drawing Sheets

WEB CONTROL MATRIX WITH SELECTABLE WEB ORIENTATION

CROSS REFERENCE TO RELATED APPLICATION

This application is entitled to the benefit of, and incorporates by reference, essential subject matter disclosed in U.S. patent application Ser. No. 09/764,930, filed on Jan. 18, 2001, now U.S. Pat. No. 6,575,399.

FIELD OF THE INVENTION

This invention relates generally to an apparatus that redirects and may reorient, or 'flip' from one side facing up to the other, a continuous web of material under tension, such as paper, fabric and the like between two processing devices such as printers, web winding machines, cutters, slitters, mergers, or folders. It is particularly directed to an apparatus that may reorient or flip a continuous paperweb prior to the web's entry into a processing devices.

BACKGROUND OF THE INVENTION

In addition to the "Background of the Invention" stipulated in the parent application referenced above, there is a need in print shops to selectively orient a paperweb so that one or the other side of the web faces up upon entering a web processing machine. Certain print jobs require single side printing, while others require printing on both sides of the web. It may be advantageous to rewind a roll of printed web with one side or the other facing up, or to slit or crosscut a web with either the even numbered or odd numbered pages facing up. What is needed in the art is an apparatus that will allow the user to select which side of the web faces up or down upon its entry into a subsequent processing machine without the need for additional processing steps or movement of equipment. In the past, print jobs were often performed in a batch process rather than a continuous process line taking a virgin roll of paperweb to a completed printed product. For example, a print job may have been partially printed on a web which was then wound on a rewind roll, the roll was then moved into alignment with the next processing device, and so on. As compared to a continuous process line, a batch process is time consuming, labor intensive, requires numerous rewind machines, and subjects the paper web to greater risk of tears and misalignment. One system that alleviates this problem for certain pre-positioned machinery is shown in co-owned U.S. Pat. No. 5,829,707, herein incorporated by reference. That patent is tailored to two processing devices whose control panels face each other, referred to as an "H-1" setup. But this system alone does not allow a user to selectively choose whether the web being fed into the second printer is in the face up or face down orientation.

Many common print jobs are executed by passing a web between two printers. In one such job requiring two-sided printing, a first printer prints on one side of the web and a second printer prints on the other side. Another such job requires printing on one side only, but the first printer executes only a portion of the print (such as black and white text) and the second printer executes the remaining portion of the print (such as color highlights). This technique optimizes speed in certain print jobs since color generally prints slower than black and white but is often less pervasive on a page.

An object of the present invention is to provide a web control matrix between two processing devices with the ability to selectively choose which side of the web faces up prior to the web's entry into a subsequent processing device.

SUMMARY OF THE INVENTION

In accordance with the present invention, a matrix is provided that enables a plurality of alternative paths for a web to pass therethough. The web has a first side facing up upon entering the matrix in a first direction and an obverse side, and exits the matrix via a second direction that may or may not differ from the first direction. The web moves through the matrix from one processing device to another such device under tension imposed by at least one of these processing devices. The matrix comprises a plurality of upright supports spaced laterally from each other; a first turnbar mounted to at least one support at an angle $\alpha$ with the first direction; a second turnbar mounted to at least one support at an angle $\beta$ with the first direction; and a third turnbar mounted to at least one support at an angle $\phi$ with the first direction. The web's obverse side faces up as it exits the matrix if the web passes about only one or all three of these turnbars, and its first side faces up as it exits the matrix if the web passes about two of these turnbars. In this manner, the web's orientation or flip, that is, whether the web's first side or its obverse side faces up, can be determined merely by threading the web in one way or another through the matrix.

The matrix may be further improved by the addition of a fourth turnbar parallel and opposite to the third, allowing the user to choose not only web orientation but the direction the web passes out of the matrix. More turnbars may be added for increased flexibility, though the most pertinent capabilities are present in the matrix incorporating four turnbars.

DETAILED DESCRIPTION

Figure 1:
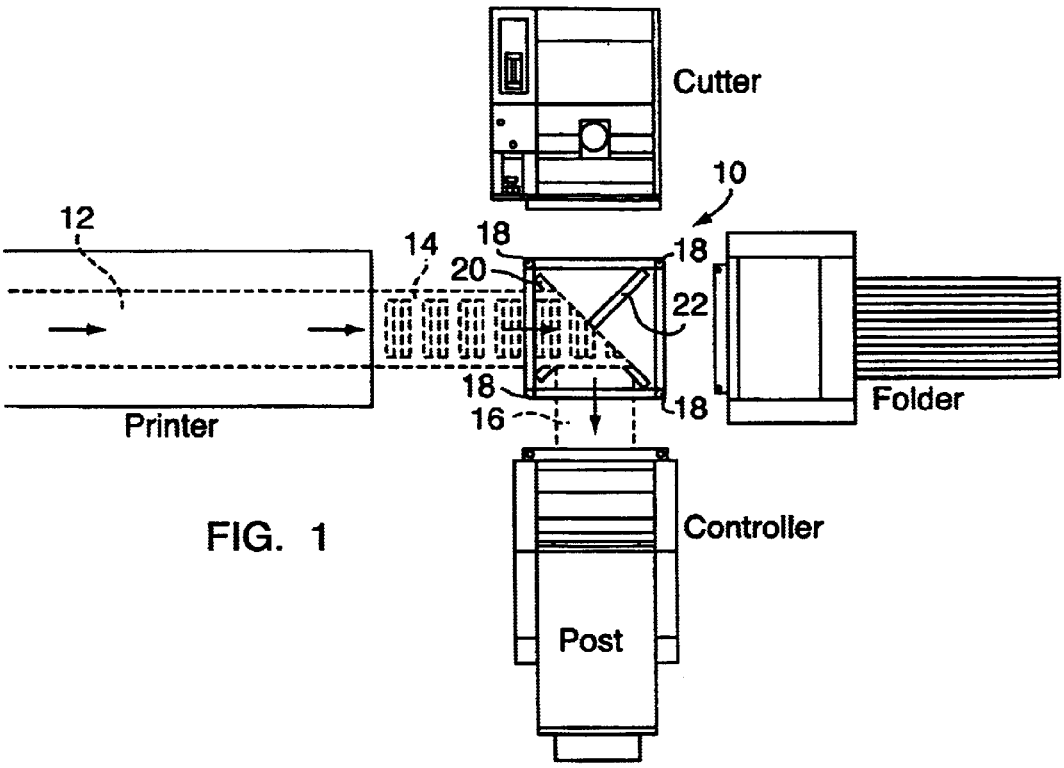
FIG. 1 is an overhead view of the preferred embodiment whereby a paperweb is routed so as to exit face-down and turned 90° to the right as compared to its orientation and direction upon entering the apparatus.

A more complete understanding of the present invention may be gleaned with reference to the illustrations, wherein each of the drawings depict a matrix 10 provided for routing paper or other continuous web material under tension between two processing devices. An array of processing devices are arranged in FIGS. 1–6 with the matrix 10 centrally located between them. A paperweb 12 is fed into the matrix 10 in the direction of the arrows from a printer or other processing device. The paperweb 12 is oriented such that a first side 14 faces up as it enters the matrix 10, and an obverse side 16 faces down. For clarity, the first side 14 is depicted as having printed matter on it, and the obverse side 16 remains blank in each of the FIGS. 1–6. The matrix comprises four upright supports 18 spanned by an upper diagonal turnbar 20, a lower diagonal turnbar 22 lying in a plane horizontally lower than that of the upper diagonal turnbar 20, and other turnbars to be later described. All turnbars of the preferred embodiment lie substantially in a horizontal plane, though such geometry is merely for convenience and simplicity. Each turnbar may be fixed or may rotate about its longitudinal axis, the preferred embodiment incorporating fixed turnbars of relatively small diameter as are commonly used in the paper processing art, generally less than 1.5" in diameter. The threading of the web 12 through the matrix 10 as shown in FIG. 1 is taken first. In order to route the paperweb 12 from the printer shown to the rewind machine labeled POST, the paperweb 12 is merely passed about the upper diagonal turnbar 20 as is common practice. This of course inverts or flips the web so that its obverse side 16 faces up as the web departs the matrix 10, and the web is re-directed 90° from its original direction.

Figure 2:
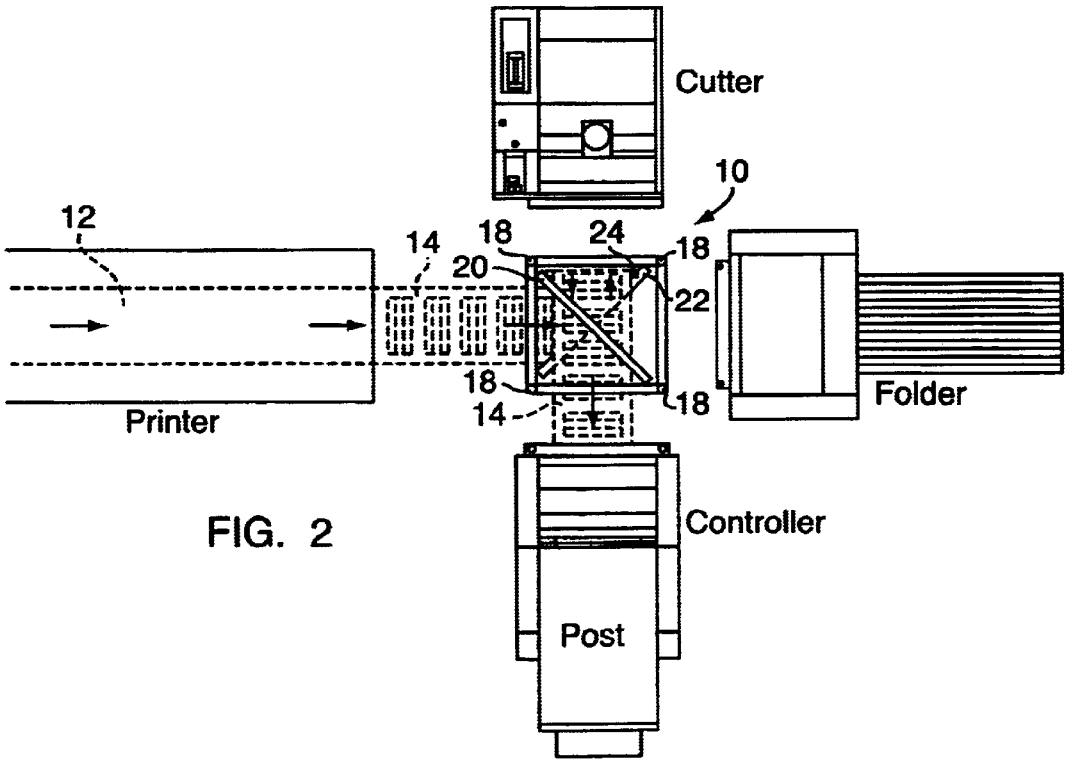
FIG. 2 is similar to FIG. 1 except the paperweb is routed to remain in a face-up orientation.

When the opposite orientation for the web is desired, that is, when it is preferred that the web enter the rewind machine with its first side 14 facing up just as it left the printer, the web need merely be re-routed through the matrix 10 as shown in FIG. 2. The web 12 is passed about the lower diagonal turnbar 22, then about a left side turnbar 24 that redirects the web 12 toward the rewind machine. The web 12 undergoes a flip at each of the turnbars 22 and 24, resulting in the first side 14 facing up as the web 12 exits the matrix 10. The left side turnbar 24 spans two adjacent upright supports 18 of the matrix 10, and is mounted in a horizontal plane between that of the two diagonal turnbars 20 and 22.

Figure 3:
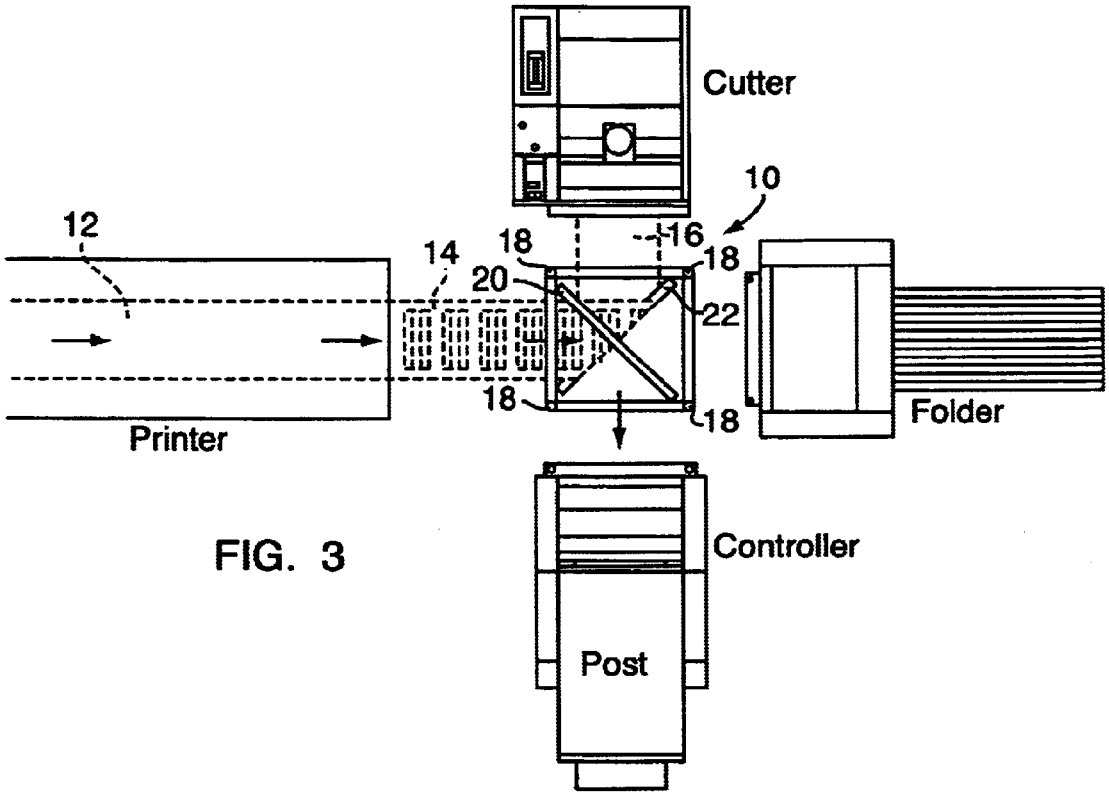
FIG. 3 is an overhead view of the preferred embodiment whereby a paperweb is routed so as to exit face-down and turn 90° to the left as compared to its orientation and direction upon entering the apparatus.
Figure 4:
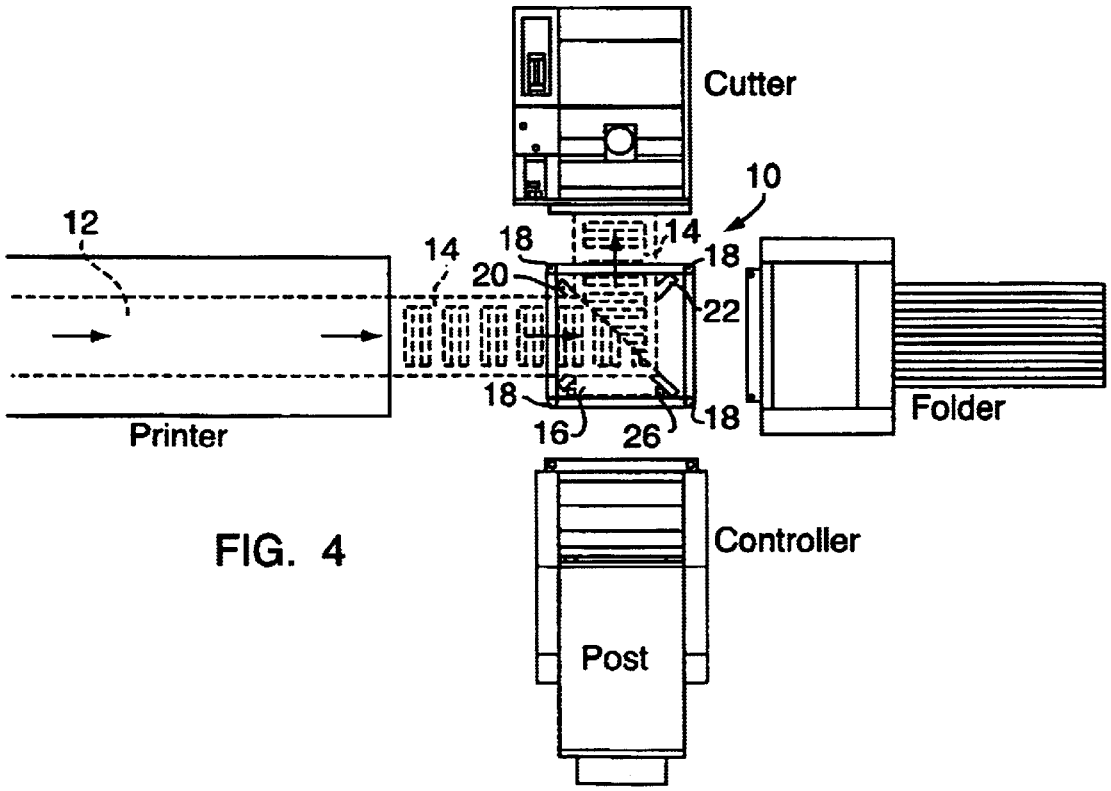
FIG. 4 is similar to FIG. 3 except the paperweb is routed to remain in a face-up orientation.

For routing the paperweb to turn 90° to the left (respecting its entry into the matrix) rather than to the right as in the previous discussion, the web is routed in a mirror fashion depicted in FIGS. 3 and 4. To orient the web 12 so that its obverse side 16 faces up upon the web's exit from the matrix 10, the web 12 is routed about the lower diagonal turnbar 22 as in FIG. 3 where the web travels from the printer to a cutter. The web may alternatively be oriented so that the first side faces up upon entry into the cutter, shown in FIG. 4. There, the web is routed around the upper diagonal turnbar and subsequently about a right side turnbar 26 that is similar to the left side turnbar 24 but on an opposing side of the matrix 10.

Figure 5:
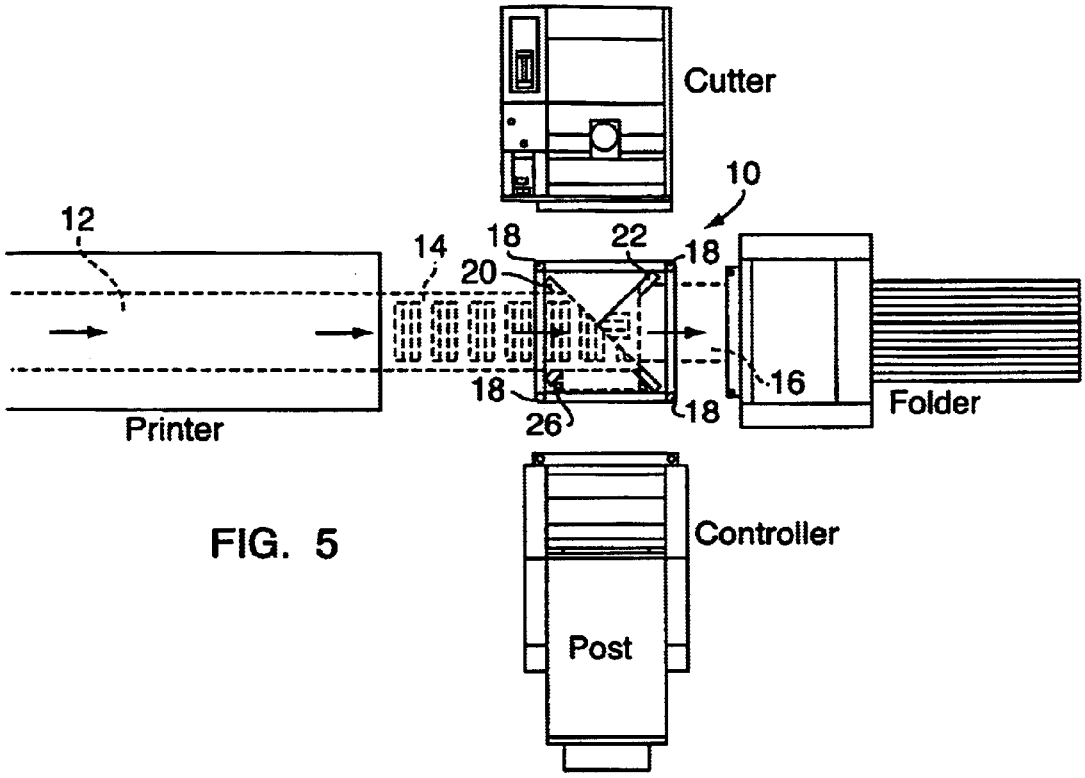
FIG. 5 is an overhead view of the preferred embodiment whereby a paperweb is routed so its net passage is straight through the apparatus and its resultant orientation is face-down as compared to its orientation upon entering.
Figure 6:
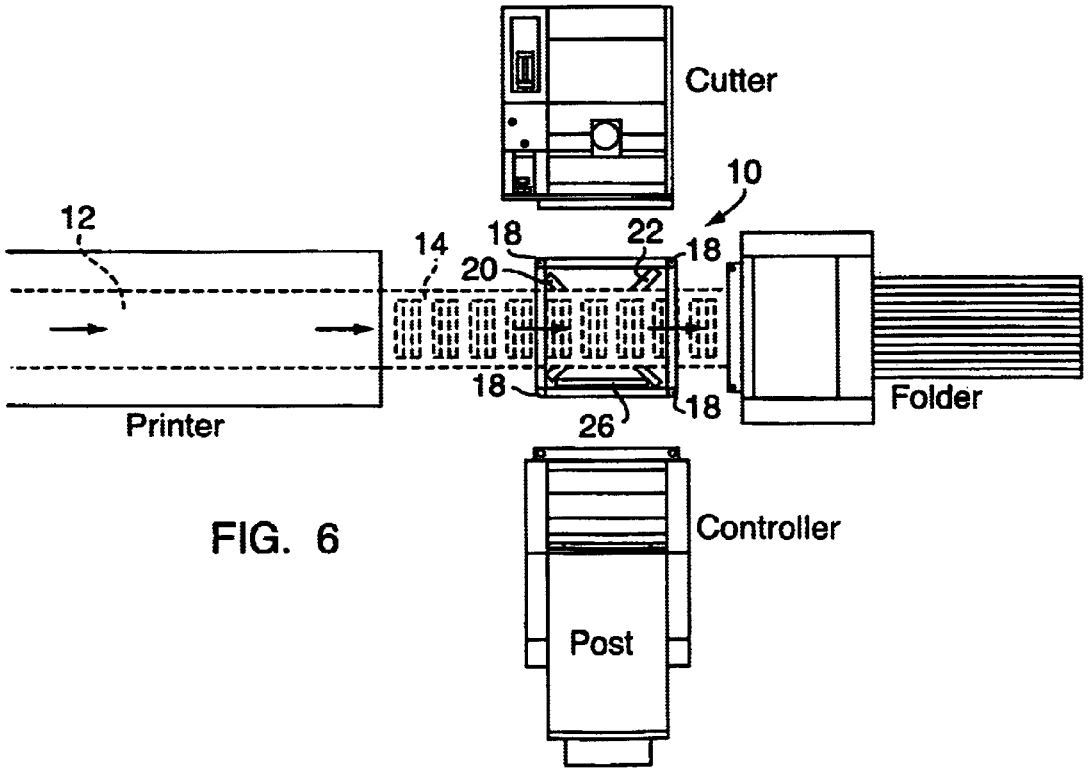
FIG. 6 is similar to FIG. 5 except the paperweb is routed to remain unflipped, and may even pass through without touching the apparatus.

Finally, the web may be oriented with either the first side 14 or the obverse side 16 facing up when the web passes through the matrix 10 without a net 90° turn, such as when routed from the printer to the folder of FIGS. 5 and 6. When orienting the web so that the obverse side faces up, the web can be threaded as in FIG. 5. The web first passes about the upper diagonal turnbar 20, then the right side turnbar 26, and finally about the lower diagonal turnbar 22. Though the web 12 is flipped three times and redirected 90° twice and 180° once while within the matrix 10, its net change is to pass 'straight' through the matrix and be flipped once, or inverted. The same result may be obtained with a mirror threading as that shown in FIG. 5. In this mirror arrangement that is equivalent, the web 12 passes first about the lower diagonal turnbar 22, then about the left side turnbar 24, and finally about the upper diagonal turnbar 20. Of course, the web may pass through the matrix 10 without encountering any turnbars and pass out unflipped along its original direction, as in FIG. 6.

It is elementary that the direction of web travel may be reversed from that depicted in FIGS. 2 and 4 with the same result. In each such reversal, the web would move from the POST or CUTTER devices depicted in FIGS. 2 and 4, which may be any processing device, to first encounter the left side turnbar 24 or right side turnbar 26. The web subsequently passes about one of the diagonal turnbars 20 or 22 to exit the matrix toward the device labeled PRINTER in FIGS. 2 and 4. That is, rather than pass about the side turnbar after the diagonal turnbar, the web may equivalently be passed about the side turnbar prior to the diagonal turnbar. Such an embodiment and re-ordering of method steps is within certain explicit claims below, and is hereby stipulated as an equivalent to those claims directed particularly toward the preferred embodiment as illustrated.

It will be appreciated that the web 12 may be threaded in numerous ways to achieve any of the net results depicted in FIGS. 1–6. The depictions herein are the simplest routing for a given desired net change in web direction and orientation. Merely complicating the threading without changing the fundamental operation of the matrix on a web is hereby considered an equivalent. More turnbars may be added along the sides adjacent to the left 24 and right 26 side turnbars so that the matrix is symmetric as viewed from above. The advantage there is that any of the purposes shown in FIGS. 1–6 may be achieved regardless of which particular matrix side faces the upstream device.

Throughout this disclosure and the ensuing claims, the term 'substantially' as referring to an angle or a horizontal, vertical or parallel alignment is hereby limited to be within 7.5° of the stipulated angle or direction. For example, substantially 90° includes all angles between 82.5° and 97.5°, inclusive. Similarly, an angle substantially bisecting 90° includes all angles between 37.5° and 52.5°, and an angle substantially bisecting a substantially 90° angle includes all angles between 33.75° and 56.25°.

When the web is described or claimed as passing about a turnbar, the term 'about' excludes passing over or under but not being redirected by the turnbar. To pass 'about' a turnbar is herein restricted to exclude those instances wherein the web circumscribes less than 90 degrees around the surface of the turnbar. For example, the web in FIG. 2 passes about the lower diagonal turnbar and the left side turnbar because it circumscribes approximately 180 degrees along the surface of each turnbar. These two turnbars act to purposefully change the direction of the web. That same web in FIG. 2 does not pass 'about' the upper diagonal turnbar. Even if the web touches the upper diagonal turnbar, it circumscribes less than 90 degrees and this latter turnbar has no purposeful effect on the direction of web travel.

While the preferred embodiment has been shown and described, additional modifications will be apparent to skilled mechanics without departing from the spirit and scope of the present invention. The embodiments described above are hereby stipulated as illustrative rather than exhaustive.

I claim:

1. A matrix for providing a plurality of alternative paths for a web, said web having a first side facing up upon entering said matrix and an obverse side, said web moving from one web processing device along a first direction to another such device along a second direction under tension imposed by at least one of said processing devices, said matrix comprising:

four upright supports spaced to define the corners of a rectangle;

a first turnbar mounted to two upright supports, said first turnbar for changing said path of said web by at least 90 degrees and defining a longitudinal axis that forms an angle $\alpha$ with said first direction;

a second turnbar mounted to two upright supports, said second turnbar for changing said path of said web by at least 90 degrees and defining a longitudinal axis that forms an angle β with said first direction; and a third turnbar mounted to two upright supports, said third turnbar for changing said path of said web by at least 90 degrees and defining a longitudinal axis that forms an angle ϕ with said first direction;

a fourth turnbar for changing said path of said web by at least 90 degrees, said fourth turnbar mounted to two upright supports, said fourth turnbar mounted on an opposing side of said matrix from said third turnbar and defining a longitudinal axis oriented at the angle ϕ with said first direction; whereby the web's obverse side faces up as it exits the matrix if the web passes about only one turnbar, and its first side faces up as it exits the matrix if the web passes about two distinct turnbars.

2. The matrix of claim 1 wherein the angle α is substantially 45°.

3. The matrix of claim 2 wherein the angle β is substantially 45° and an angle between said first and second turnbar longitudinal axes is substantially 90°.

4. The matrix of claim 3 wherein the angle ϕ is either substantially 0° or substantially 90°.

5. The matrix of claim 4 wherein said second direction is perpendicular to said first direction.

6. The matrix of claim 5 wherein said first direction and said second direction are the same when said web passes either about no turnbars or about said first, second, and one of said third or fourth turnbars.

7. The matrix of claim 5 further comprising a fifth and sixth turnbar each mounted on opposing sides of said matrix to two upright supports, said fifth and sixth turnbars for changing said path of said web by at least 90 degrees each defining a longitudinal axis that forms an angle substantially 90° with said first direction.

8. The matrix of claim 5 wherein said web exits said matrix with its first side facing up if it passes about an even number of turnbars or no turnbars, and with its obverse side facing up if it passes about an odd number of turnbars.

9. The matrix of claim 7 wherein said second direction is either perpendicular to or the same as said first direction.

10. The matrix of claim 1 wherein the angle α bisects said first and second direction.

11. The matrix of claim 10 wherein said first and second turnbar longitudinal axes are substantially perpendicular to each other.

12. The matrix of claim 11 wherein the first and second turnbar longitudinal axes lie in distinct planes, each such plane being substantially horizontal.

13. The matrix of claim 1 wherein said matrix is free-standing.

14. A free standing matrix for providing a plurality of alternative paths for a web, said web having a first side facing up upon entering said matrix and an obverse side, said web moving from one web processing device along a first direction to another such device under tension imposed by at least one of said processing devices, said matrix comprising:

a first, second, third and fourth upright support each spaced laterally from each other and defining the corners of a rectangle wherein said first and third supports are not adjacent to one another, said web entering said matrix between said first and fourth supports;

a first turnbar for changing said path of said web by at least 90 degrees mounted substantially horizontally between the first and third supports at an angle substantially 45° to the first direction;

a second turnbar for changing said path of said web by at least 90 degrees mounted substantially horizontally between the second and fourth supports at an angle substantially perpendicular to the first turnbar;

a third turnbar for changing said path of said web by at least 90 degrees mounted substantially horizontally between the first and second supports at an angle substantially parallel to the first direction; and a fourth turnbar for changing said path of said web by at least 90 degrees mounted substantially horizontally between the third and fourth supports at an angle substantially parallel to the first direction;

whereby the web exits the matrix between either the first and second, second and third, or third and fourth supports with its obverse side facing up if the web passes about either one or three turnbars, or with its first side facing up if the web passes about either no turnbars or two turnbars.

15. A matrix for providing a plurality of alternative paths for a web, said web having a first side facing up upon entering said matrix and an obverse side, said web moving from one web processing device along a first direction to another such device along a second direction under tension imposed by at least one of said processing devices, said matrix comprising:

a plurality of upright supports spaced laterally from each other;

a first turnbar mounted to at least one support, said first turnbar defining a longitudinal axis that forms an angle α with said first direction, said first turnbar is in a first plane;

a second turnbar mounted to at least one support, said second turnbar defining a longitudinal axis that forms an angle β with said first direction, said second turnbar in a second plane;

a third turnbar mounted to at least one support, said third turnbar defining a longitudinal axis that forms an angle ϕ with said first direction, said third turnbar in a third plane; and said third plane of said third turnbar is between said first and second planes of said first and second turnbars; whereby the web's obverse side faces up as it exits the matrix if the web passes about only one turnbar, and its first side faces up as it exits the matrix if the web passes about two distinct turnbars.

* * * * *